United States Patent [19]

Evans et al.

[11] 4,135,376

[45] Jan. 23, 1979

[54] PATIO DOOR SECURITY BAR WITH LOCK

[75] Inventors: Arthur A. Evans, North Miami Beach; Morton S. Rifkin, Hialeah, both of Fla.

[73] Assignee: Charles Bar-Lok Corp., Glenwood, Ill.

[21] Appl. No.: 814,490

[22] Filed: Jul. 11, 1977

[51] Int. Cl.[2] ..... E05B 65/08

[52] U.S. Cl. ..... 70/100; 70/370; 70/94; 292/142

[58] Field of Search ..... 70/95, 120, 370, 451, 70/452, 94, 99, 100, 81; 292/142, 259, 338; 49/449

[56] References Cited

U.S. PATENT DOCUMENTS

| | | | |
|---|---|---|---|
| 1,994,095 | 3/1935 | Caldwell | 70/120 |
| 3,449,934 | 6/1969 | Check | 70/452 |
| 3,821,884 | 7/1974 | Walsh | 70/95 |
| 3,947,060 | 3/1976 | Zimmer | 292/142 |

*Primary Examiner*—Robert L. Wolfe

*Attorney, Agent, or Firm*—Silverman, Cass & Singer, Ltd.

[57] ABSTRACT

A patio door or sliding window security bar which is of the type that is normally stored parallel to a frame member of the opening and movable to a horizontal position braced against the sliding panel frame or jamb so that the sliding panel cannot be moved to give access through the opening. A bolt is fully contained within the hollow bar end and capable of being reciprocated through the medium of a barrel or cylinder that is installed into the lateral wall of the bar to enable the bolt to be moved into a socket formed in the sliding panel frame to lock the bar against being swung upward or downward. A locking arrangement including a keyway enables the bar to be locked in horizontal position by means of a removable key to prevent unauthorized opening of the patio door even from the interior of the building having the opening.

14 Claims, 6 Drawing Figures

FIG. 1
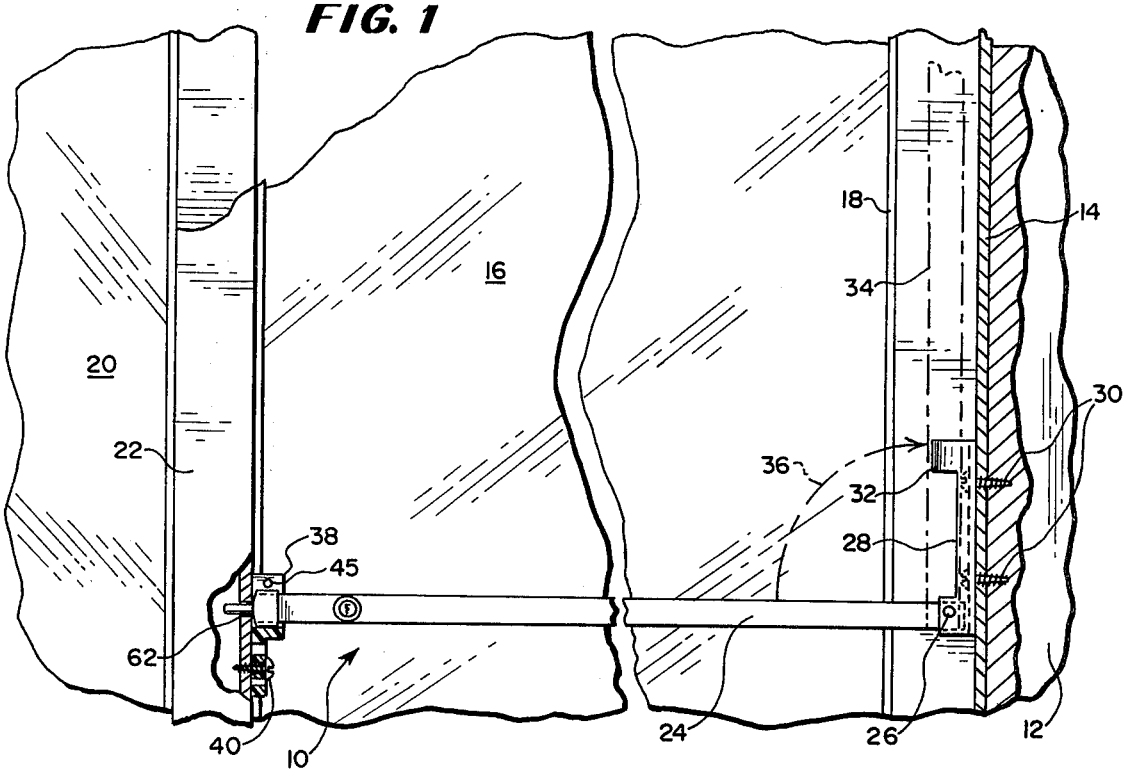
FIG. 3
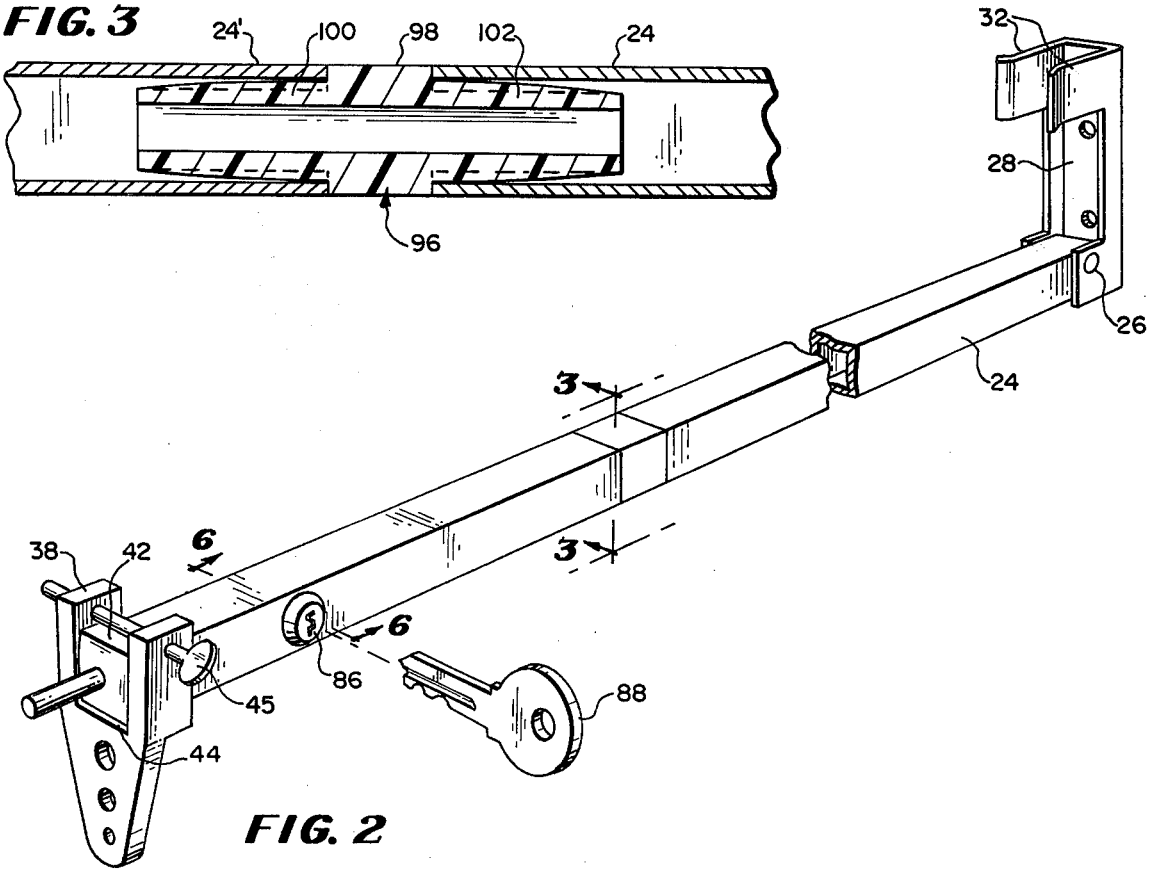
FIG. 2

FIG. 4
FIG. 5
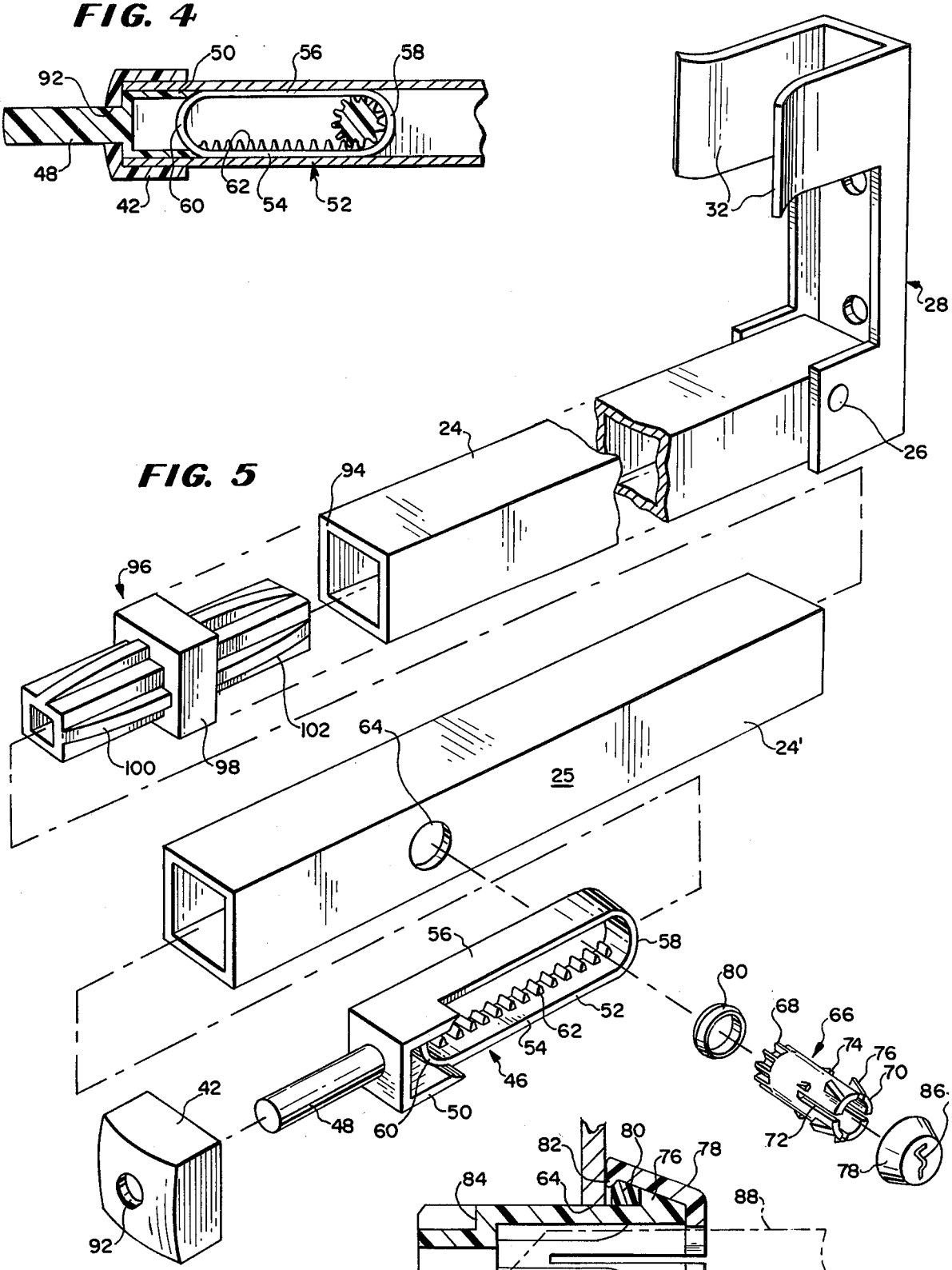
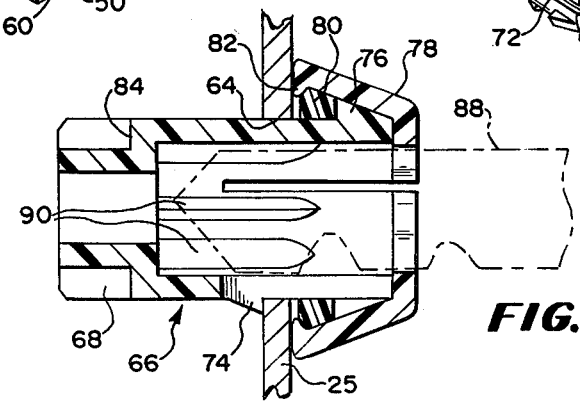
FIG. 6

PATIO DOOR SECURITY BAR WITH LOCK

CROSS-REFERENCE TO RELATED PATENT

U.S. Pat. No. 3,328,920 issued July 4, 1967 to Charles Cohen and one of the applicants herein, entitled "Locking Bar for Patio Door" and assigned to the assignee of this invention is incorporated herein by reference.

FIELD OF THE INVENTION

The field of the invention is the same as that of U.S. Pat. No. 3,328,920 incorporated by reference, namely, security bars for sliding patio doors or windows.

BACKGROUND OF THE INVENTION

For the most part, the background of the invention is fully described in the patent incorporated by reference.

As seen the bar of the invention is normally a hollow extrusion of aluminum having a square cross section secured by a hinged pivot to the vertical frame of a patio door opening and normally arranged for storage parallel with said vertical frame. When stored thusly, the panel of heavy glass which slides in the opening can be moved freely towards the vertical frame, the opening being twice the size of the glass panel and there being a second fixed panel which the first panel overlies when the access is given through the opening to the building or out of the building in which the patio doors are installed. It is appreciated that even in opened condition half of the large opening is still covered; both panels blocking the opening when the doors are in closed condition.

The bar is stored vertically and when swung to a blocking position is rotated in a clockwise direction if the hinge is considered to be on the viewers left. This brings the free end down into the bight of a U-shaped bracket where it rests. To remove the bar from its horizontal blocking condition, one raises the free end out of the bight of the U-shaped bracket.

Complete security cannot be achieved if access can be had to the interior of the patio doors, either by an intruder actually entering or by such intruder slipping a wire or other instrumentality through a crevice from the exterior of the patio doors into the interior and hooking its bent end around the bar and raising it out of the bight of the U-shaped bracket. Additionally small children can readily raise the bar from the interior of the house to enable them to open the patio doors without parental authority.

The invention obviates these problems by providing a lock for the bar which is adapted to be operated by means of a tool such as a key from the interior of the doors.

While sounding simple, the problems of providing a lock for the kind of security bar here involved is not readily capable of solution for a variety of reasons. Some of these are listed below:

1. The width of patio door panels vary from structure to structure making it well nigh impossible to install a lock on the bars as manufactured, hence there must be some way for the lock to be installed by an amateur or a workman in the field. The installation must be effective to have any value and hence the arrangement must be foolproof.

2. The lock arrangement must be capable of being installed on existing security bars without the need for taking the system apart, or at least without requiring substantial substitution of parts.

3. It was considered that great advantages could be effected if the entire mechanism could be substantially contained within the bar itself, but since these bars are for the most part commercially made out of 5/8 inch outer diameter square tubing with the hollow interior having an interior dimension of one half inch, the solution to the problem is not obvious.

4. The lock arrangement is required to be extremely simple to manufacture and install and additionally is required to be economical for the user to purchase.

The invention achieves a solution to all of these problems in a structure which can be sold in kit form as parts to be installed into the end of a bar without doing anything to the bar other than drilling a hole in the side wall of the bar or in the form of a short bar section that is coupled to the end of an existing bar after the free end of the bar has been shortened by sawing it off. In both cases, in addition to the single hole required to be drilled in the side wall of the bar another hole is required to be drilled in the jamb of the sliding door. In some cases the bar may be carried by the jamb and the free end is to be engaged at the door frame in which case the hole to receive the bolt of the lock is drilled in the frame. This hole is called a bolt end receiving socket in the specification.

SUMMARY OF THE INVENTION

An attachment for a patio door security bar or a structure combined with such a bar in which the bar has a hollow tubular end and adapted to be mounted on one of the vertical framing members of a patio door opening or a panel that slides in the opening. The bar is normally moved from a vertical stored position to a horizontal blocking condition extended between the sliding panel and a vertical frame of the opening.

The structure includes a central sliding bolt contained on the interior of the hollow end of the bar with a part of the body that is engaged with a barrel or cylinder that enters through a side wall of the bar and engages the bolt body. There is a rack and pinion connection between the bolt body and the barrel and the barrel is secured to the bar with an end cap having a keyway so that it can be turned by means of an external key. The end cap is freely rotatable independently of the barrel without the key in position so that the bolt cannot be moved without the key. The central sliding bolt is preferably formed of a single integral member of plastic molded to shape and has a free end that is cylindrical, adapted to be pushed out of the end of the bar and into a suitable socket drilled in the frame of the opening. Its body has a central square section that slides inside of the square hollow of the bar and an elongate oval section following the square section that has teeth along one of its long sides to form a rack. The proximal end of the barrel has a pinion gear formed thereon which is engaged in the oval section with its teeth meshed with the rack and confined between the rack and a long side of the oval. The ends of the oval prevent the pinion from moving past the rack and hence the bolt is limited in its movement within the hollow and confined. Thus no other means of fastening or defining the stroke of the bolt are required.

The invention lies in the system resulting from the installation of the lock and in an attachment that has the lock installed and can be plugged into the bar after an end has been sawn off to shorten the same.

BRIEF DESCRIPTION OF THE DRAWINGS

FIG. 1 is a side elevational view with portions shown in section illustrating the lock means of the invention installed in a patio door or the like security bar;

FIG. 2 is a perspective view of the bar itself on an enlarged scale but in this case, the installation comprises an attachment in the form of a short hollow section having the lock installed in the section and the section coupled to the shortened end of a security bar, the view also showing in exploded sense a key adapted to operate the lock;

FIG. 3 is a sectional view taken generally along a portion of the structure of FIG. 2 shown at 3—3 and in the indicated direction;

FIG. 4 is a median sectional view taken through the end of the bar of FIG. 1 or 2;

FIG. 5 is an exploded perspective view of all of the parts of the bar of FIG. 2 and illustrates generally the manner of assembly thereof; and FIG. 6 is a sectional view taken generally along the line 6—6 of FIG. 2 and in the indicated direction.

DESCRIPTION OF THE PREFERRED EMBODIMENTS

As indicated above the invention is concerned with a security locking bar for patio doors, the basic concept of which is disclosed in detail in the referenced patent incorporated herein, namely U.S. Pat. No. 3,328,920.

In FIG. 1 there is illustrated a fragment of what has been referred to in the claims as a patio door or the like locking bar system designated generally by the reference character 10. Simply stated this is a rigid bar which is moved to prevent the sliding panel of a pair which comprise the closure of an opening in a building from being moved to a condition which gives access to the building.

The building or structure in this case is designated 12 and is framed by a vertical framing member or structure 14. This, together with other framing structures (not shown) will define the opening in which the so-called patio doors are installed. There is normally a fixed panel of glass 16 which is set in a frame 18 and a slidable panel 20 whose frame includes a vertical framing member 22. In FIG. 1 the panel 20 is intended to slide to the right as viewed in the figure so that the framing member 22 will come adjacent the framing member 18 and the two panels 16 and 20 will overlie one another. The opening giving access to the building will then be on the left.

According to U.S. Pat. No. 3,328,920, a security arrangement is provided in which there is a square cross-section elongate extruded aluminum bar 24 that is hollow on its interior, is pivoted at 26 to a bracket 28 that is fastened to the framing member 14 by means of the screws 30 or other fastening means. The upper end of the bracket 28 has a pair of spring fingers 32 into which the bar 24 may be pressed and held as indicated by the phantom lines 34 when the bar is in quiescent or stored position. Note that the bar is rotated around the pivot 26 in a clockwise direction as viewed in FIG. 1 to achieve its stored position at 34, this movement being indicated by the broken arrow line 36.

Further, according to the disclosure of U.S. Pat. No. 3,328,920 a bracket 38 which is basically U-shaped is fastened to the framing member 22 of the panel 20 by suitable screws 40 and the bar 24 which usually has a plastic trim cap 42 engaged over its free end is dropped into the bight 44 of the bracket 38 so that the bar 24 assumes the position which is shown in FIG. 1 to lock the patio doors. To enable movement of the panel 20 to the right it is necessary to raise the bar 24 to its position of storage at 34 after removing a simple blocking pin 45.

As thus far described in this specification the security bar system is known. Intruders or unauthorized persons need merely raise the free end of the bar out of bracket 38 in order to enable the panel 20 to be moved to the right as shown in FIG. 1 to give access to the building. The invention obviates this as stated.

In FIG. 1 it is assumed that the invention has been installed in a bar 24 that has not been altered from its original condition. The invention comprises a bolt designated generally 46 which preferably is molded from synthetic resin as an integral member. There is cylindrical extension 48, a middle rectangular formation 50 forming one part of the body and an elongate oval formation 52 opposite the extension 48 and comprising the second part of the body. The oval is elongate and flattened on its top and bottom thereby providing the ribbon-like elongate walls 54 and 56 and the arcuate end walls 58 and 60. A row of gear teeth 62 formed on the inside of the bottom wall 54 comprises a rack.

The dimensions of the square section 50 are such as to fit into the square hollow of the body of the bar 24 or as in the case of the attachment which will be described, into the short length of bar 24'.

The bolt 46 is intended to reciprocate along the length of the bar 24 or the short length 24' and cause the extension 48 to be inserted into a suitable hole 62 that is drilled in the vertical framing member 22 of the panel 20, this latter being termed a bolt end receiving socket.

The lateral wall of the bar 24 or the short length 24' is drilled during installation to provide a passageway 64 and a rotary barrel or cylinder 66 is installed in this passageway. The barrel is best seen in FIGS. 5 and 6.

The end of the barrel 66 which is inserted through the passageway 64 is called herein the proximal end 68 and this is formed with gear teeth so that it constitutes a pinion, having the same pitch and size as the teeth of the rack 62. The end of the barrel 66 which protrudes according to the invention herein is called the distal end and is designated 70. The barrel is split as shown at 72 starting at the distal end and extending about halfway along its length so that flexible segments are formed. There are two sets of detents 74 and 76 around the circumference of the barrel 66, the detents 74 being located about in the center and the detents 76 being located adjacent the distal end 70. A frusto-conical cap 78 is adapted to be engaged over the detents 76, there being a retainer ring 80 dimensioned to pass into the interior of the cap 78 and snap under the inwardly extending formation 82 provided on the interior of the cap 78.

The barrel is confined between the elongate walls 54 and 56 of the bolt section which thereby prevent the barrel pinion from moving away from and out of engagement with the rack teeth 62. Likewise, the barrel pinion is located between the end walls 58 and 60 of the bolt oval and engagement of the barrel pinion with either end wall prevents the barrel from moving past the rack. This engagement between the barrel and bolt is the sole means used for securing the bolt within the bar and/or defining the stroke of the bolt.

The procedure of assembly is first to insert the bolt into the hollow of the bar 24 or the short length 24' and move it so that the oval 46 is aligned with the passageway 64. The ring 80 may be snapped into the cap 78 in the meantime or may be engaged over the proximal end 68 of the barrel 66 which is then inserted through the passageway 64 and into engagement with the rack 62. The detent 74 will pass through the passageway 64 by constricting slightly and thereafter expanding to their normal condition engaged behind the lateral wall 25. The barrel 66 cannot be inserted past the rack 62 because of the shoulders 84 engaging the lateral ends of the rack teeth. A cap 78 will capture the ring 80 between the wall 25 and the detents 76.

Rotating the barrel 66 will obviously reciprocate the bolt 46. Rotating the cap 78 will not effect such reciprocation because of the intervention of the ring 80 which serves somewhat as a bearing member. The cap accordingly has a key-way 86 formed in its end adapted to receive therein the key 88 which can enter into the interior of the barrel 66 where there are ridges 90 formed that engage the body of the key and cause the key 88, cap 78 and the barrel 66 to be coupled together.

In use the cap 42 is required to have a central passageway 92 to accommodate the extension 48.

As explained, the bolt 46, barrel 66, ring 80 and cap 78 may readily be installed in an existing bar 24 by simply drilling the hole 64 and following the assembly procedure which has been described. The bar 24 may be left in place or it may be removed from the patio doors and drilled on a bench. A kit of the parts described can be sold for the use of users having the installation already in place as described in U.S. Pat. No. 3,328,920.

For the convenience of those who do not wish to drill the passageway 64 and assemble the parts described, it is feasible to provide them with a short length of bar 24' which has the entire lock assembly already installed. The user then cuts the bar 24 at a suitable distance from its free end as indicated at 94, inserts a double ended coupling plug 96 which has a central flush block 98 and oppositely extending male friction parts 100 and 102 into the resulting hollow and thereafter couples the short length 24' to the bar 24. The cap 42 is slipped over the resulting free end and the installation is ready for use.

Conveniently the plug 96 may be molded of a synthetic resin to provide a force-fit in coupling the bar 24 and the short length 24' together.

It is clear that variations in the details of the invention may be made without departing from the spirit or scope thereof as defined in the appended claims.

What it is desired to secure by Letters Patent of the United States is:

1. In a patio door or the like locking bar system in which a rigid bar is hingedly secured by one end thereof to a first vertical frame member of one of a framed glass panel and a framed opening in which the said panel slides, said bar adapted to be swung between a normally inoperative condition in vertical disposition alongside of said first vertical frame member to a horizontal position with the free end of the bar disposed at the second vertical frame member whereby the bar blocks the sliding movement of said panel, the invention herein which comprises, A. at least the free end of the bar being hollow, B. a sliding bolt in the bar end, said bolt having an elongate body including a slot formed therein defining two elongate facing walls and a rack formed along one of these elongated walls, C. a rotary barrel in a lateral wall of the bar adjacent the end, D. a motion-transmitting coupling between the barrel and bolt enabling rotary motion of the barrel to be converted into rectilinear sliding movement of the bolt within the hollow end of the bar, said coupling means including a pinion formed on the proximal end of the barrel and fitted in the slot and engaged with the rack and the proximal end of the barrel also engaging the other of the elongate slot walls to prevent the pinion from moving out of the rack, E. the barrel having means for enabling the engagement of an actuating tool or the like therewith from exterior of the bar to rotate the barrel, the second vertical frame member adapted to have a bolt-receiving socket therein at the level which meets the bar when in said horizontal disposition whereby movement of the bolt into said socket will lock the bar in the horizontal disposition.

2. The invention as claimed in claim 1 in which the cross-section of the bar end is rectangular, the bolt includes a portion which is of conforming configuration to enable sliding within the bar end without rotation and the barrel extends through a planar wall and has its proximal end in engagement with the interior portion of the bolt.

3. The invention as claimed in claim 1 in which the barrel is secured to said wall intermediate the length thereof, the proximal end of the barrel being inaccessible from outside of the bar, the distal end of the barrel having a freely rotating cap engaged thereon with a central tool-fitting opening, the barrel having formations on its interior adapted to engage with a tool inserted through the tool-fitting opening whereby, with the tool not present, rotating the cap in attempting to rotate the barrel will be ineffectual.

4. The invention as claimed in claim 1 in which stop means are formed at each end of the rack integral with the bolt adapted to be engaged laterally by the proximal end of the barrel during rotation thereof whereby to limit its motion relative to the rack and hence to confine and define the rectilinear sliding movement of the bolt.

5. An attachment for a patio door or the like security locking bar system in which there is a rigid bar hingedly secured by one end thereof to a first vertical frame member of one of a framed glass panel and a framed opening in which the panel slides, said bar adapted to be swung between a normally inoperative condition in vertical disposition alongside of said first vertical frame member to a horizontal position with the free end of the bar disposed at the second vertical frame member whereby the bar blocks the sliding movement of said panel, said attachment adapted to replace a length of the bar removed from its free end and comprising:

A. a hollow length of tubing of a configuration adapted to conform to that of said bar and of a dimension adapted to be substituted for the length of bar removed, B. means in one end of the tubing to enable firm coupling of the length of tubing with the bar end and leaving the other end of the tubing length free, C. an interior sliding bolt in the free end of the tubing length having a section thereof fully contained within the tubing and reciprocable therein with an integral extension adapted to protrude from the free end and adapted to enter a suitable receptor socket which may be formed therefor in the said second vertical frame member, the said extension being retractable substantially completely within the said tubing length, D. a rotary barrel installed in a lateral wall of the tubing length and having its proximal end engaged with the said bolt section fully contained within the tubing, there being cooperating means on the said proximal end and section enabling rotation of the barrel to reciprocate the bolt in rectilinear movement, said cooperating means comprising a rack formed on the bolt and a pinion formed on said proximal end of the barrel and engaged with said rack, and E. the distal end of the barrel being exposed and including means mounted thereon to enable rotation of the barrel from the exterior of the bar.

6. The attachment as claimed in claim 5 in which said last mentioned means comprise key engaging means to enable rotation of the barrel through the use of an external, removable key.

7. The attachment as claimed in claim 6 in which said key engaging means comprises a cap engaged over said distal end of the barrel and freely rotatable independently of the barrel but capable of being locked to said barrel to enable rotation of the barrel with said cap when engaged by said external removable key.

8. The attachment as claimed in claim 5 in which means are provided on the bolt opposite the rack to prevent the pinion teeth from moving out of the rack.

9. The attachment as claimed in claim 8 in which stop means are formed on the bolt at opposite ends of the rack whereby to limit the said reciprocating movement of said bolt within said hollow length of tubing without the need for any additional medium such that assembly of the bolt and barrel is achieved by inserting the bolt into the tubing length from the free end thereof and thereafter inserting the barrel through the lateral wall and into engagement with the bolt.

10. The attachment as claimed in claim 9 in which the bolt is an integral molded member of synthetic resin having the extension and a generally rectangular section inwardly of the extension, an elongate flat sided oval section of generally ribbon-like walls inwardly of the rectangular section with the ends of the oval forming the stop means, one of the long flat sides of the oval having the rack teeth formed therein and the other of the long flat sides being engaged by the pinion during rotation thereof to prevent the pinion teeth from moving free of the rack.

11. The invention as claimed in claim 1 in which stop means are formed on the bolt at opposite ends of the rack whereby to limit the said reciprocating movement of said bolt within said bar without the need of any additional medium such that the assembly of the bolt and barrel is achieved by inserting the bolt into the end of the hollow bar and thereafter inserting the barrel through the lateral wall and into engagement with the bolt.

12. The invention as claimed in claim 11 in which the bolt is an integral molded member of synthetic resin and in which the slot is in the form of an elongated flat sided oval section wherein said facing walls and said opposite stop means are defined peripherally of the slot.

13. In a patio door or the like locking bar system in which a rigid bar is hingedly secured by one end thereof to a first vertical frame member of one of a framed glass panel and a framed opening in which the said panel slides, said bar adapted to be swung between a normally inoperative condition in vertical disposition alongside of said first vertical frame member to a horizontal position with the free end of the bar disposed at the second vertical frame member whereby the bar blocks the sliding movement of said panel, the invention herein which comprises, A. at least the free end of the bar being hollow, B. A sliding bolt in the bar end, said bolt having an elongate body including a slot formed therein defining an elongate wall and a rack formed along the elongate wall and upstanding stop means located adjacent the opposite ends of the rack, C. a rotary barrel in a lateral wall of the bar adjacent the end, D. a motion-transmitting coupling between the barrel and bolt enabling rotary motion of the barrel to be converted into rectilinear sliding movement of the bolt within the hollow end of the bar, said coupling means including a pinion formed on the proximal end of the barrel and fitted in the slot and engaged with the rack and being separately engageable with the stop means to confine and define the rectilinear sliding movement of the bolt, E. the barrel having means for enabling the engagement of an actuating tool or the like therewith from exterior of the bar to rotate the barrel, the second vertical frame member adapted to have a bolt-receiving socket therein at the level which meets the bar when in said horizontal disposition whereby movement of the bolt into said socket will lock the bar in the horizontal disposition.

14. In a patio door or the like locking bar system in which a rigid bar is hingedly secured by one end thereof to a first vertical frame member of one of a framed glass panel and a framed opening in which the said panel slides, said bar adapted to be swung between a normally inoperative condition in vertical disposition alongside of said first vertical frame member to a horizontal position with the free end of the bar disposed at the second vertical frame member whereby the bar blocks the sliding movement of said panel, the invention herein which comprises, A. at least the free end of the bar being hollow, B. a sliding bolt in the bar end, C. a rotary barrel in a lateral wall of the bar intermediate the length thereof but adjacent the end, said barrel having walls axially split along a portion of its length adjacent its distal end and a series of detents on said walls, the first series being at said distal end and the second series being spaced therefrom, the second series of detents enabling the barrel to be snapped into the bar through said lateral wall and the wall having a passageway therein permitting of such action during assembly of the barrel to the bar, the proximal end of the barrel being inaccessible from outside of the bar, D. a freely rotating cap engaged on the distal end of the barrel and having a central tool-fitting opening, the cap having an interior ring formation which has an interior diameter slightly larger than that of the barrel but substantially smaller than the exterior diameter of the first series of detents whereby to enable the cap to be snapped over the first series of detends and retained on the distal end of the barrel, E. a motion-transmitting coupling between the barrel and bolt enabling rotary motion of the barrel to be converted into rectilinear sliding movement of the bolt within the hollow end of the bar, F. the barrel having formations on its interior adapted to engage with an actuating tool inserted through the tool-fitting opening from the exterior of the bar whereby, with the tool not present, rotating the cap in attempting to rotate the barrel will be ineffectual, the second vertical member adapted to have a bolt-receiving socket therein at the level which meets the bar when in said horizontal disposition whereby movement of the bolt into said socket will lock the bar in the horizontal disposition.

* * * * *